United States Patent [19]

Ikeda et al.

[11] Patent Number: 4,674,054

[45] Date of Patent: Jun. 16, 1987

[54] AUTOMATIC CONTROL METHOD FOR COKE OVEN WORKING MACHINES AND FIXED POSITION CONTROL APPARATUS THEREFOR

[75] Inventors: Minoru Ikeda; Yasuyuki Higashigawa, both of Wakayama, Japan

[73] Assignee: Sumikin Coke Company Limited, Wakayama, Japan

[21] Appl. No.: 828,605

[22] Filed: Feb. 12, 1986

Related U.S. Application Data

[63] Continuation of Ser. No. 479,124, Mar. 28, 1983, abandoned.

[30] Foreign Application Priority Data

Mar. 26, 1982 [JP] Japan ..... 57-49812
Mar. 29, 1982 [JP] Japan ..... 57-50464
Oct. 26, 1982 [JP] Japan ..... 57-188769

[51] Int. Cl.[4] ..... B61L 25/00; B61L 3/00; G06G 7/70

[52] U.S. Cl. ..... 364/477; 364/426; 246/187 B

[58] Field of Search ..... 364/477, 426; 202/262; 246/187 B; 377/3, 17, 18; 235/462–466; 318/602, 605, 640, 660

[56] References Cited

U.S. PATENT DOCUMENTS 3,590,355 6/1971 Davis ..... 318/602
3,728,539 4/1973 Thorne-Booth ..... 246/187 B X
3,839,664 10/1974 Dirks ..... 318/602
3,877,666 4/1975 Itakura et al. ..... 246/187 B X
3,893,695 7/1975 Rickert ..... 346/426 X
4,066,230 1/1978 Nohmi et al. ..... 246/187 B X
4,072,885 2/1978 Emark, Jr. ..... 202/262 X
4,190,498 2/1980 Teschner et al. ..... 202/262
4,196,471 4/1980 McClure ..... 364/477 X
4,208,717 6/1980 Rush ..... 246/187 B X
4,330,830 5/1982 Perry ..... 364/426 X
4,384,695 8/1983 Nohmi et al. ..... 364/426 X
4,528,683 7/1985 Henry ..... 377/34

*Primary Examiner*—Jerry Smith
*Assistant Examiner*—Allen MacDonald
*Attorney, Agent, or Firm*—Watson, Cole, Grindle & Watson

[57] ABSTRACT

A method is provided for automatically controlling both the running operations of traveling machines including a pusher machine, a charging car, a coke guide and/or solely a quenching car. Transposed-pair-type inductive radio lines capable of data transmissions are arranged over the whole length of the running path of the respective traveling machines. The absolute addresses of the traveling machines are continuously located at a main control system by means of a continuously position detecting mechanism resorting to an absolute address detecting method. Instructions to consecutively effect the running, stopping and working operations of the traveling machines are generated by grasping the positions and working states of the traveling machines on the basis of the control programs of the respective working steps, all of which are stored in the main controller, and on the basis of the speed and work data fed from the traveling machines, and the positions and working states of the same machines. Also disclosed is a fixed position stop control apparatus for the automatic control method.

2 Claims, 17 Drawing Figures

| | | | | | | | | | | | | |
|---|---|---|---|---|---|---|---|---|---|---|---|---|
| Gn | 0 | 0 | 0 | 0 | 0 | 1 | 1 | 1 | 1 | 1 | 1 | 1 |
| G2 | 0 | 1 | 1 | 1 | 1 | 1 | 1 | 1 | 1 | 0 | 0 | 0 |
| G1 | 1 | 1 | 1 | 0 | 0 | 0 | 0 | 1 | 1 | 1 | 1 | 0 |
| G0 | 0 | 0 | 1 | 1 | 0 | 0 | 1 | 1 | 0 | 0 | 1 | 1 |

| | | | | | | | | | | | | | |
|---|---|---|---|---|---|---|---|---|---|---|---|---|---|
| H0 | 1 | 1 | 0 | 0 | 1 | 1 | 0 | 0 | 1 | 1 | 0 | 0 | 1 |
| H1 | 0 | 1 | 1 | 1 | 1 | 0 | 0 | 0 | 0 | 1 | 1 | 1 | 1 |
| H2 | 0 | 0 | 0 | 1 | 1 | 1 | 1 | 1 | 1 | 1 | 1 | 0 | 0 |
| H3 | 0 | 0 | 0 | 0 | 0 | 0 | 0 | 1 | 1 | 1 | 1 | 1 | 1 |

QUENCHING TOWER

AUTOMATIC CONTROL METHOD FOR COKE OVEN WORKING MACHINES AND FIXED POSITION CONTROL APPARATUS THEREFOR

This application is a continuation of application Ser. No. 479,124, filed Mar. 28, 1983, now abandoned.

BACKGROUND OF THE INVENTION

The present invention relates to an automatic control system for the operation of cokery machinery, in particular, the running, stopping and working operations of the traveling machines used therein, such as a pusher machine, a charging car, a coke guide and a quenching car, the operation of a stop control apparatus for stopping the respective traveling machines highly accurately at predetermined positions, and the control of auxiliary cokery machinery including a quenching tower, a coke wharf, exhausters of deduster, etc.

The discharging works of red hot coke from the oven chamber are accomplished by repeating predetermined works through the consecutive operations of respective traveling macbines to such an oven chamber as has been determined in advance on the basis of the working schedule. When the respective traveling machines are to conduct their predetermined works, moreover, they are required to proceed their works while communicating with one another to confirm their relative works and positions.

In the prior art, the mutual communications and confirmations of those traveling machines have been effected either by the naked eye or by the use of telephones or radio lines. With such a communication method, however, a false report can occur, and the confirmation of the relative positions cannot be completely ensured.

Therefore, a number of remote controls for the running of a coke quenching car locomotive have been tried, including a recent method in which the running of a series of traveling machines are to be automatically controlled.

Nevertheless, such automatic control is generally directed to a method in which the respective traveling machines, equipped with transmitters and receivers, are controlled by sending an instruction through a relay from one of the traveling machines to another, or to a method in which the positions of the traveling machines are confirmed and the working conditions of the same are controlled by a ground location detector. This makes it remarkably difficult to automatically control with safety and without fail the discharging works which are located in hot and restrictive areas in which much dust and water vapor is generated.

If, for example, the remote control of the quenching car locomotive is taken up, the quenching car locomotive is stopped at a predetermined position relative to a coke guide, is started in synchronism with the pusher ram speed of a pusher machine, is run toward a quenching tower after the red hot coke is loaded in the quenching car and is stopped at a predetermined position in the quenching tower, in which it is exposed to quenching water. After this quenching operation, the quenching car locomotive is moved to an empty coke wharf for dumping the quenching cokes into the coke wharf, and is again run toward the coke guide for coke loading purposes. After a series of these automatic operations, the quenching car locomotive detects during its operation a number of fixed points for conducting decelerating and stopping operations suitable for the fixed points. Since the method under consideration is dependent upon the track conditions such as slipperiness, however, it is difficult to accurately control the running of the quenching car locomotive and to stop it accurately.

In this regard, since the track of the quenching car locomotive fluctuates horizontally and vertically more than 200 mm with respect to relative distances from horizontal and vertical reference lines, the distance between ground detectors, indicating the fixed points, and an on-board detector, carried on the quenching car locomotive for detecting the fixed points when it passes over the ground detectors, is changes without any interruption so that the detecting accuracy cannot be maintained.

Therefore, in a coking plant which is initially constructed to include provision for the remote control of the quenching car locomotive, the track is made so firm as to maintain the detecting accuracy. In order to maintain such accuracy, however, it is necessary to prepare a strong foundation, which involves high costs. On the other hand, this reinforcement is operationally impossible for an existing coking plant and even if the detecting accuracy of the ground detector and the on-board detector is maintained, control by the mutual detections of the on-board detectors of the coke guide and the quenching car locomotive cannot yield the required stopping accuracy because of the short braking distance.

As a method of eliminating the aforedescribed defects, there has been devised with a considerable effect the so-called "relative address detecting method", in which the running distance of the quenching car locomotive is read out to locate its position. In this method, however, the idler wheels of the quenching car locomotive rotate along the track so that the running distance is read out in terms of the wheel turns. This inevitably induces errors resulting from the slippage or the like of such idle wheels. Therefore, the ground detectors are disposed at several positions over the entire length of the runnning path of the quenching car locomotive so that any errors from the absolute positions may be remedied when those ground detectors are passed over.

Thus, the aforementioned method has succeeded in reducing the number of ground detectors more than other approaches employed by the prior art but has failed to provide a basic solution for the problem which is made likely between ground detectors and the on-board detector.

Moreover, in the event the electric power is interrupted, the quenching car locomotive cannot be located because of the running distance during such power interruption. It therefore becomes necessary to manually run the quenching car locomotive to a reference point and to renew the running operation from such a reference point.

Also, the traveling machines generally used adopt an A.C. electric motor as the drive source. However, the traveling machines using such an A.C. electric motor cannot have their speeds controlled because the r.p.m. of the electric motor is determined in accordance with the frequency of the power source.

In the prior art, the braking device provided for stopping those traveling machines comprises a wheel tread brake including a brake shoe, a device for braking the rotary shaft of a drive mechanism by means of a thrust brake or the like, and so on.

When the braking operations are carried out by any of these brake devices, the traveling machines are stopped at their destinations by manually interrupting the braking forces while visually confirming the destinations.

However, when an automatically operated controller is utilized introduced in recent years, it becomes remarkably difficult, when using such a braking system, to effect the stoppage accurately at each destination if the traveling machines are to be automatically stopped.

For example, if a braking force is applied at a predetermined point before the destination, the wheels may slip after stopping their rotation. As a result, it makes automatic control difficult to expect a constant distance from a braking point to a stopping point due to reliance on track conditions such as wetness caused by rain or water, oil blots or track level.

Therefore, there has been proposed with a considerable effect a method by which a D.C. electric motor is used as the drive source of the traveling machines, wherein the r.p.m. of the electric motor is stepwise reduced from a predetermined point before the destination and wherein a braking force is applied after the speed is decreased to a predetermined low level and at a point where the distance to the destination reached is at a predetermined value. However, such method has still failed to solve the problem in that the error in the distance from a braking point to a stopping point is not made constant in accordance with the track conditions, although it is reduced. Moreover, the cycle times required for the discharging are elongated because the speed is stepwise reduced. Still moreover, a high expenditures are required for reconstructing the drive mechanism and for installing a rectifier.

SUMMARY OF THE INVENTION

It is, therefore, an object of the present invention to solve all of the aforedescribed problems, to automatically control the cokery machinery, to stop the traveling machines highly accurately and correctly at predetermined positions without markedly reconstructing the existing traveling machines and tracks of the coke oven plant, and to provide both a method for automatically controlling the working steps to be conducted by the respective traveling machines by the use of an inductive radio line system and a fixed position stopping control apparatus for the respective traveling machines.

According to a feature of the present invention, there is provided an automatic control system for coke oven works, comprising the steps of: arranging transposed-pair-type inductive radio lines capable of data transmissions over all the working steps of the respective traveling machines including a pusher machine, a charging car, a coke guide and a quenching car locomotive or the working steps of at least the quenching car; detecting the absolute positions of the respective traveling machines continuously in time and in space at a central control system by means of a continuously address detecting mechanism resorting to an absolute address detecting method; and instructing to consecutively effect the running, stopping and working operations of the respective traveling machines by maintaining the positions and working conditions of the respective traveling machines or only the quenching car locomotive on the basis of the control programs of the respective working steps and center addresses of the respective coke oven chamber, which are stored in the central control system the speed and work data fed from said respective traveling machines, and the positions and working conditions of the respective traveling machines. According to another feature of the present invention, there is provided a fixed position stop control apparatus in the traveling machines including a continuous absolute address detector and a speed detector, the apparatus comprising: a hydraulic disc brake mounted on the drive mechanism of the traveling machine; a controller for detecting and feeding a difference between an actual speed and a predetermined speed by comparing both the distance to a stop position and the actual speed, which are continuously detected and fed by the continuous absolute address detector and the speed detector, respectively, with a reference deceleration pattern which is determined from the predetermined speed and a distance to a stop position, and an hydraulic controller for continuously controlling the braking force of the disc brake on the basis of the output signal of the controller.

It should be pointed out that the drive mechanism of the traveling machines, as termed herein, includes the electric driving motor and the portions of a reduction gear mechanism, both of which are mounted on the cars of those machines.

BRIEF DESCRIPTION OF THE DRAWINGS

Other objects, features and advantages of the present invention will become more apparent from the following detailed description taken in conjunction with the accompanying drawings, in which.

DETAILED DESCRIPTION OF THE PREFERRED EMBODIMENT

Figure 1A:
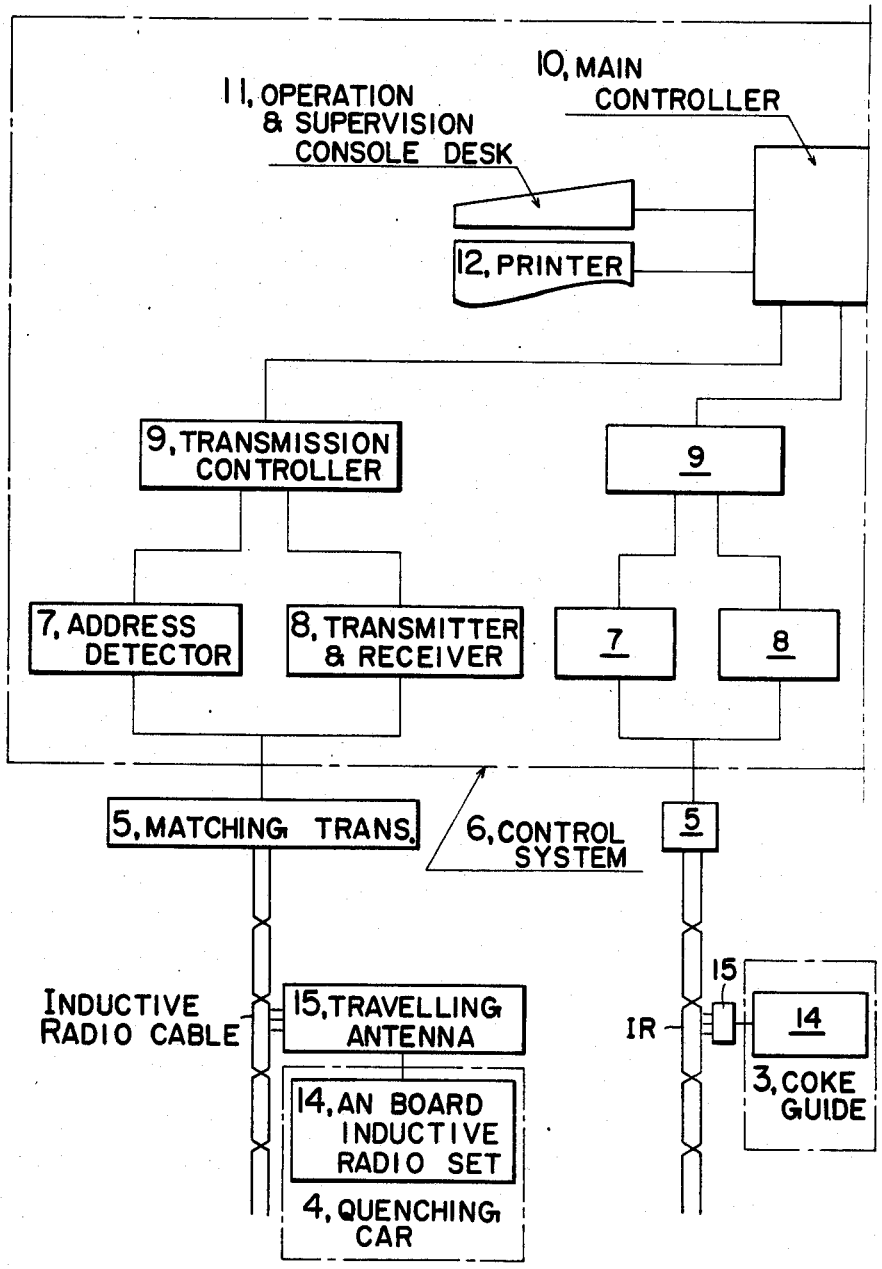
FIGS. 1A and 1B are parts of a block diagram showing one embodiment of an automatic control system for a coke oven plant according to the present invention.
Figure 1B:
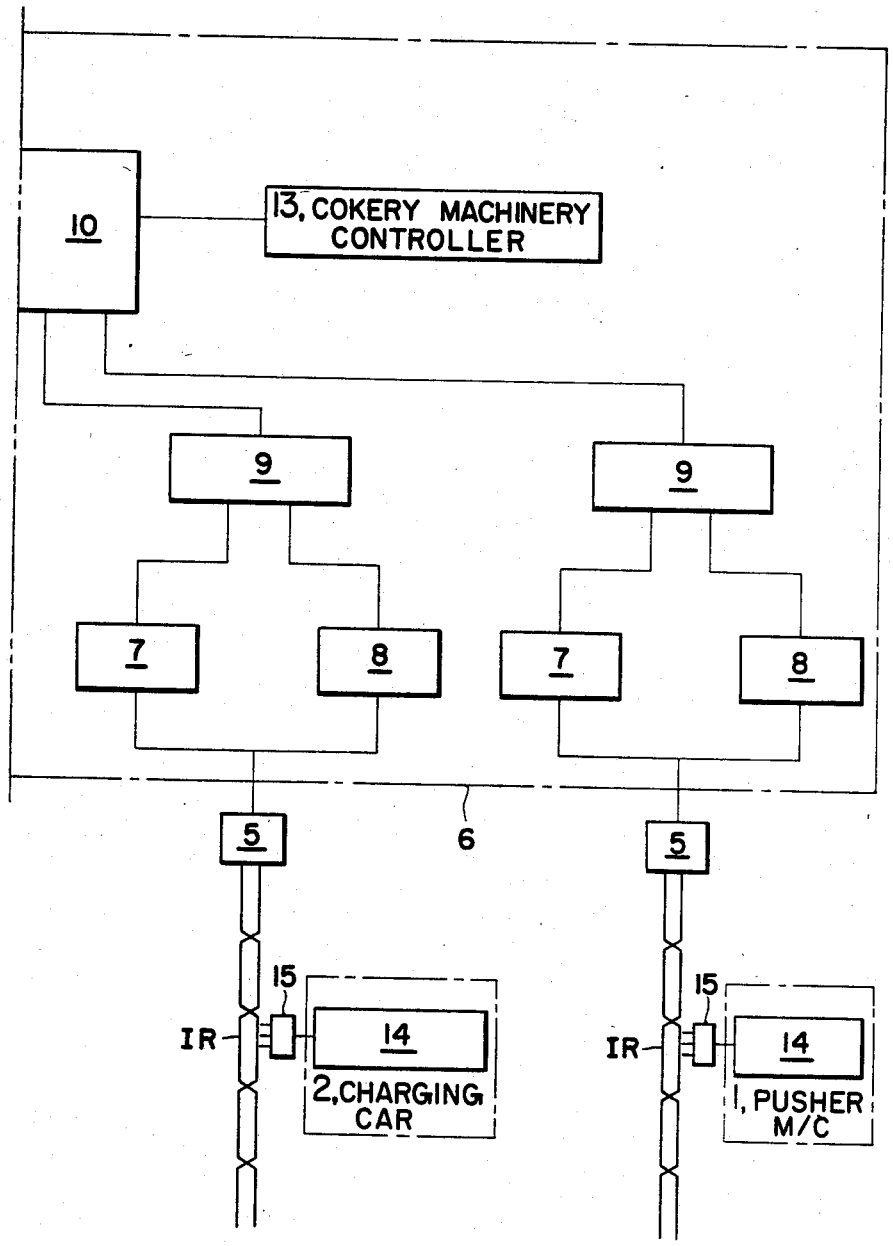

The automatic controls of the respective traveling machines will be first described as follows:

As shown in FIGS. 1A and 1B, there are arranged transposed-pair-type inductive radio cables (hereinafter referred to as IR cables) which are capable of effecting data transmissions over the whole length of the running path of the respective traveling machines which include a pusher machine 1, a charging car 2, a coke guide 3 and a quenching car locomotive 4. The IR cables have their matching transes 5 connected with address detectors 7, and transmitter-receivers 8 of a central control system 6 for the respective traveling machines. The address detectors 7 and the transmitter-receivers 8 are respectively connected through a transmission controller 9 with a main controller 10. This main controller 10 is connected with an operation and supervision console desk 11, a printer 12 and an auxiliary coking machinery controller 13.

On the pusher 1, the charging car 2, the coke guide 3 and the quenching car locomotive 4, on the other hand, there are respectively mounted on-board inductive radio sets 14 so that data and instructions can be transmitted through a travelling antenna 15 between the inductive radio sets 14 and the main controller 10 so that the absolute addresses of the respective traveling machines 1 to 4 can be continuously located by the action of the continuous position-detecting mechanism resorting to the absolute address location.

The continuous address-detecting mechanism resorting to that absolute address detection is composed of an absolute address detector and a continuous address detector.

Figure 2:
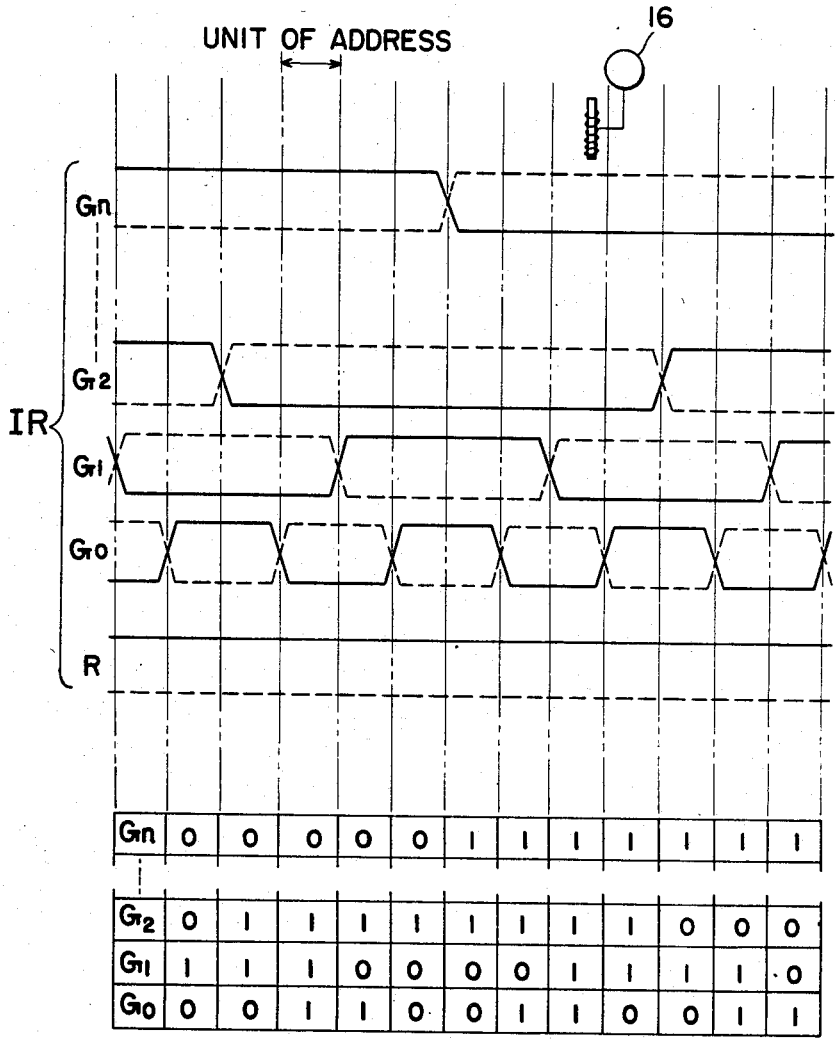
FIG. 2 is an explanatory diagram illustrating the principle of an absolute address location by a phase discrimination method.

FIG. 2 illustrates the principle of the absolute address detection by the phase discrimination method. The signals, which are to be received by both phase reference pairs R having no transposition and transposed paired lines $G_0$ to $G_n$ transposed with different pitches, both belonging to the IR cables, are so binary designated that their portions in phase with the phase reference pairs R are expressed by "0" whereas their portions in opposite phase to the pairs R are expressed by "1", so that the addresses can be located by $2^n$ over the whole length of the running passages of the respective traveling machines 1 to 4. This location is combined with a method, by which the minimum transposed pitches are further continuously resolved by the continuous position detection shown in FIG. 3, because its minimum unit for the address detection is about 100 mm.

Figures 3A, 3B, 3C:
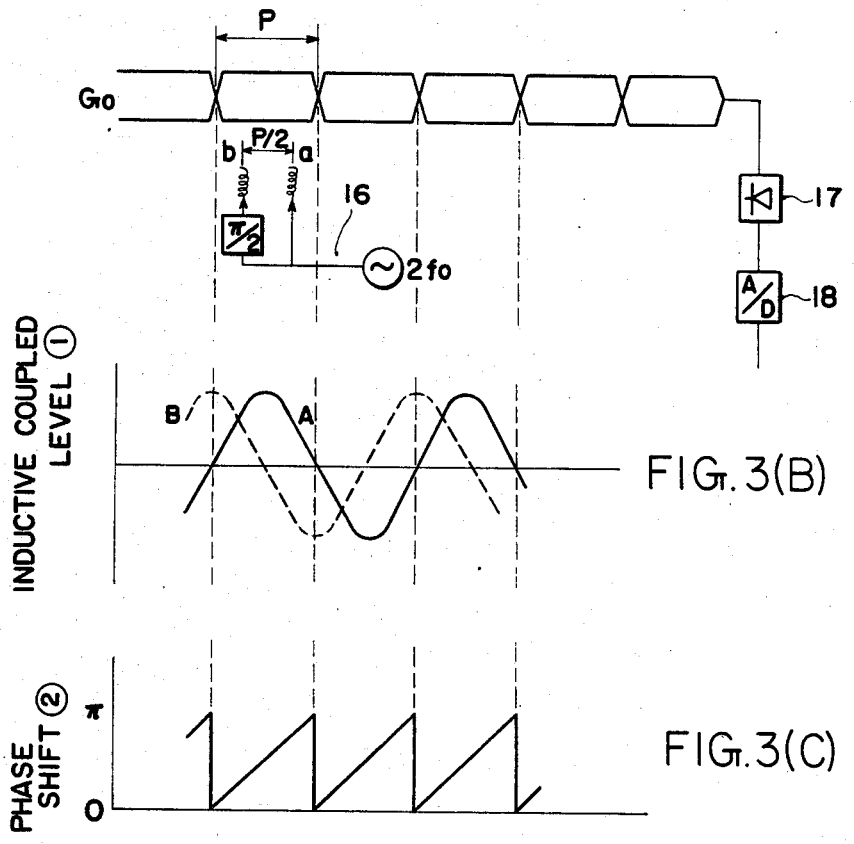
FIGS. 3A to 3C are explanatory diagrams illustrating the principle of a continuous position detection.

FIGS. 3(A) to 3(C) illustrate the principle of the continuous position detection. The received levels of the minimum transposed pair lines $G_0$ intersecting at a predetermined period "P" takes their minimum at the intersection of the paired lines $G_0$ and their maximum at intermediate portions, and their level fluctuations can be made to take a generally sinsoidal shape by properly selecting the interval P between the intervals, the traveling shape of the antenna and the distance between the IR cables and the traveling antenna. As illustrated in FIG. 3(A), one of the signals from an oscillator 16 is subjected to an electrical phase shift of $\pi/2$ radian. After that, such inductively coupled level patterns A and B as have their inductive radio line intersecting interval spacially shifted by P/2, as shown in FIG. 3(B), are transmitted from two antennas a and b. On the other hand, the aforementioned signals received by the paired line $G_0$ are fed through a phase detector 17. Then, there can be attained such a phase shift as is proportional to the distance from the intersection, as shown in FIG. 3(C).

This change in the phase shift is converted by an A/D converter 18 to continuously generate the distances from the intersection of the antennas.

Figure 4:
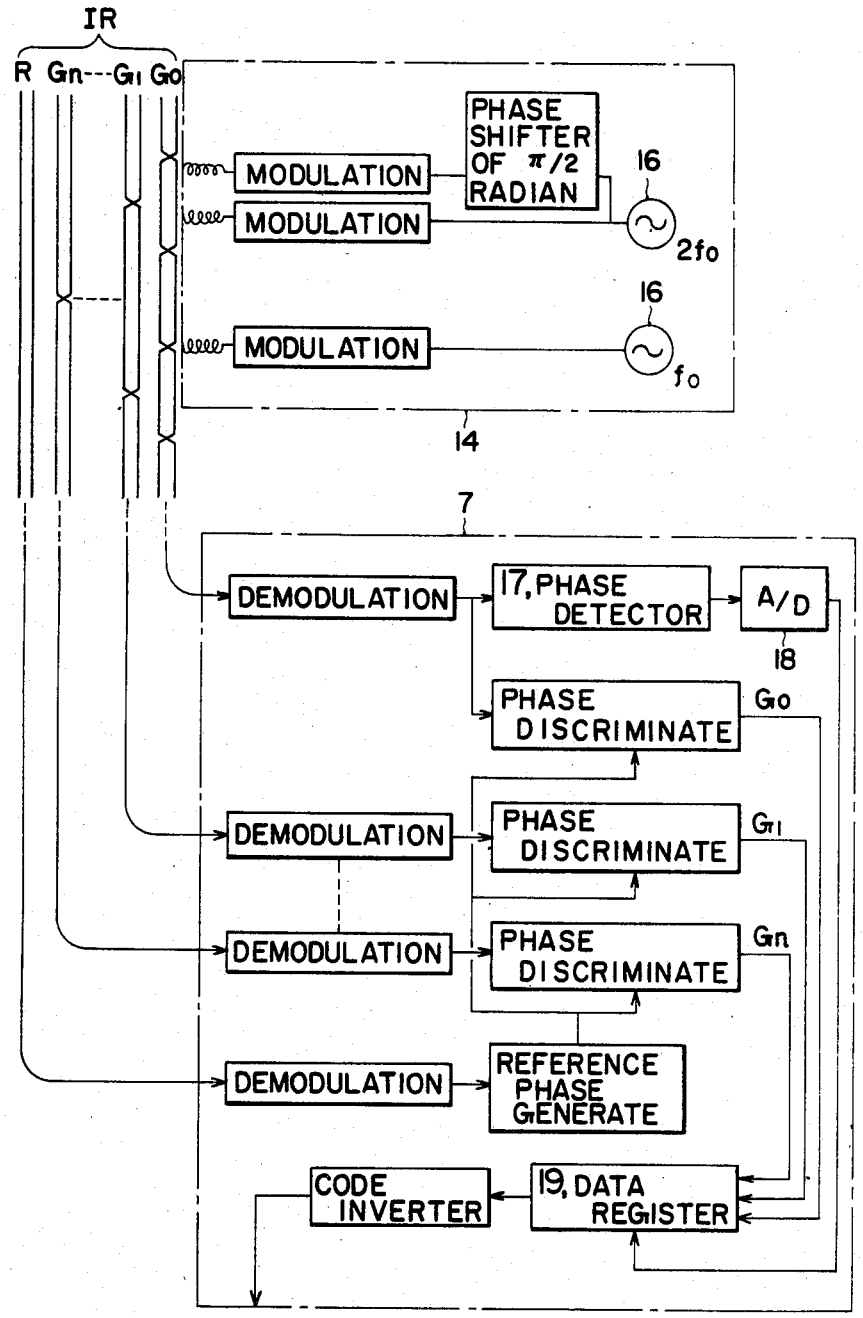
FIG. 4 is a block diagram showing a continuous address detector.

FIG. 4 is a block diagram showing one example of the present address locator. By the oscillator 16 of the inductive radio set 14 on each of the traveling machines 1 to 4, there are transmitted with modulations the reference pulses having a frequency $f_0$ for the phase reference pairs R and a frequency $2f_0$ for the respective pairs $G_0$ to $G_n$. At the respective address detectors 7 of the central control system 6 installed on the ground, on the other hand, the pulse signals $2f_0$ received by the respective paired lines $G_0$ to $G_n$ transposed are demodulated and are discriminated whether they are in phase with or in opposite phase to the pulse signal $f_0$ having been received and demodulated by the reference pairs until they are stored in a data register 19.

Moreover, the distances from the intersection, which are discriminated from the phase shift in the transposed pitches P of the minimum transposed paired lines $G_0$ by the aforementioned continuous address location are simultaneously stored in the data register 19. The absolute addresses of the respective traveling machines over the whole length are located continuously in time and in space from those composed distances and are transmitted to and stored in the central controller 10 through the respective communication controller 9.

Figure 5:
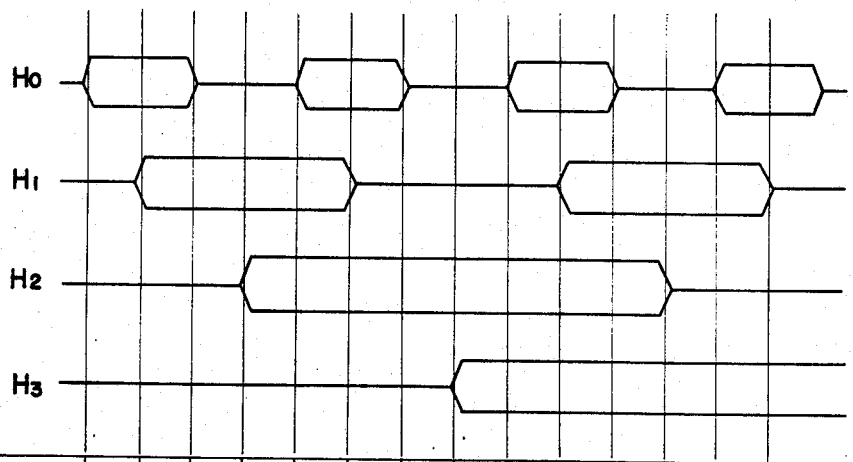
FIG. 5 is an explanatory diagram illustrating the principle of an absolute address location by a level discrimination method.
Figure 6A:
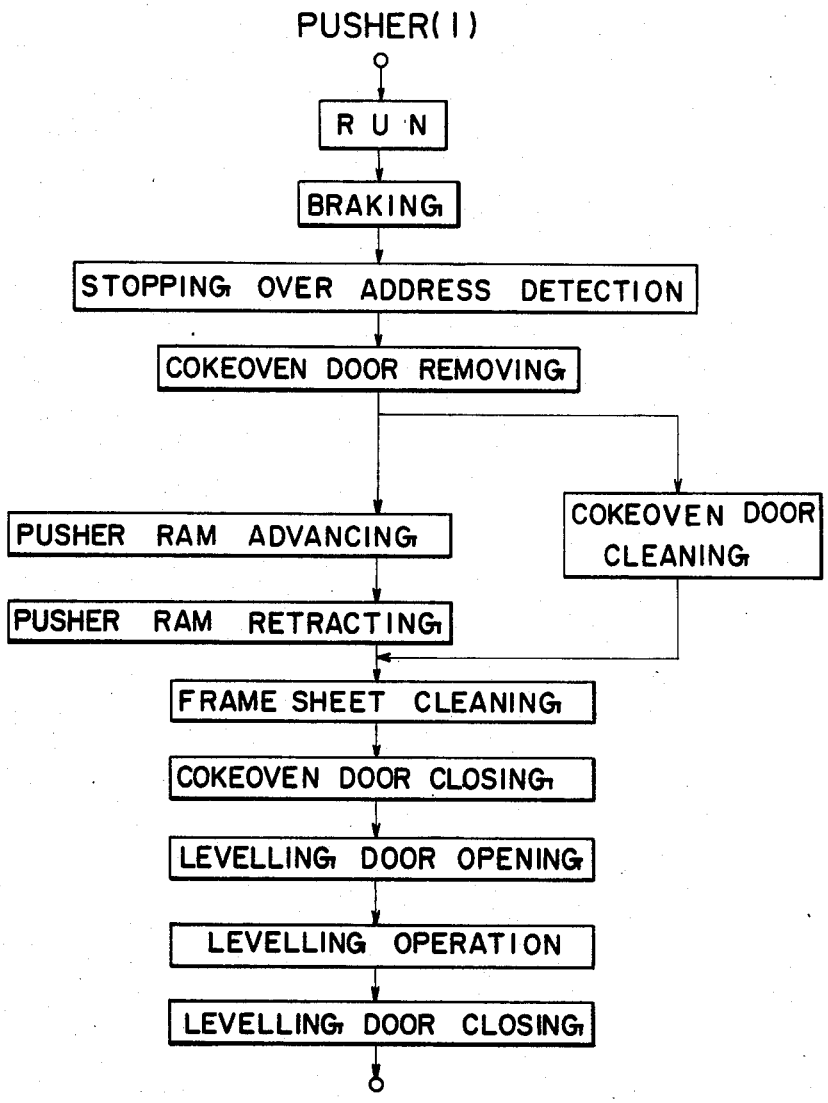
FIGS. 6A to 6E are parts of a block diagram illustrating the working programs of respective traveling machines.
Figure 6B:
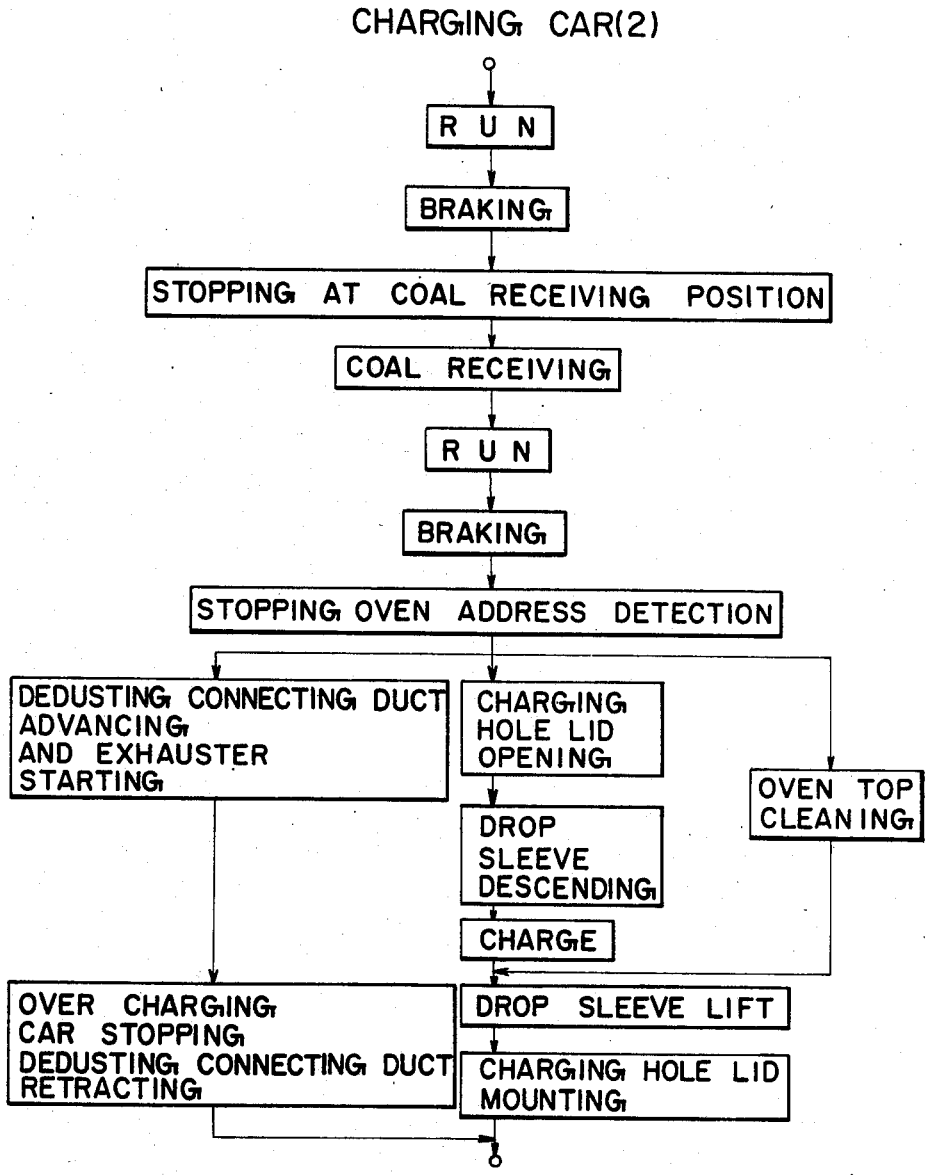
Figure 6C:
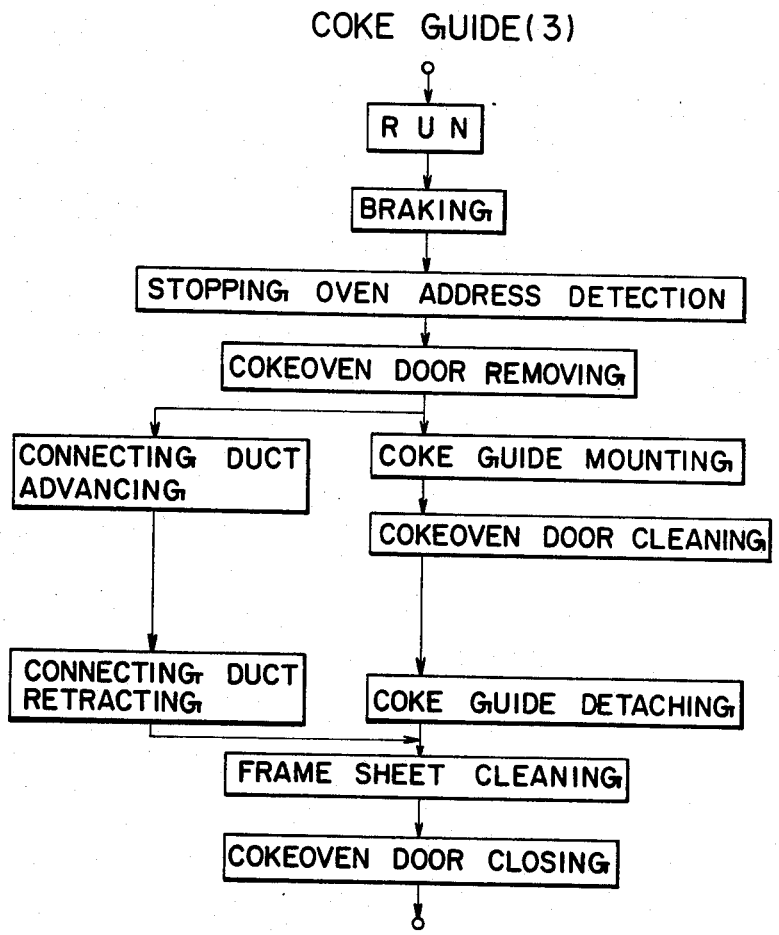
Figure 6D:
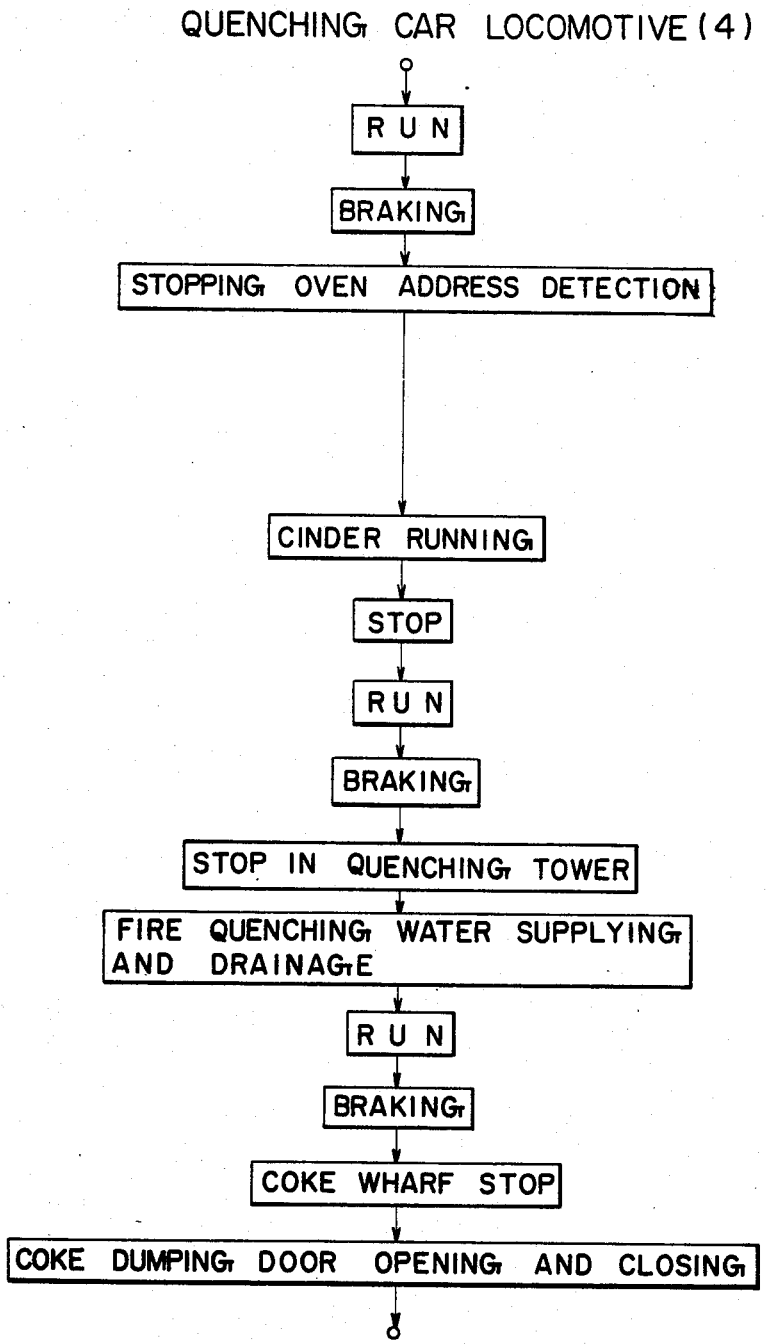
Figure 6E:
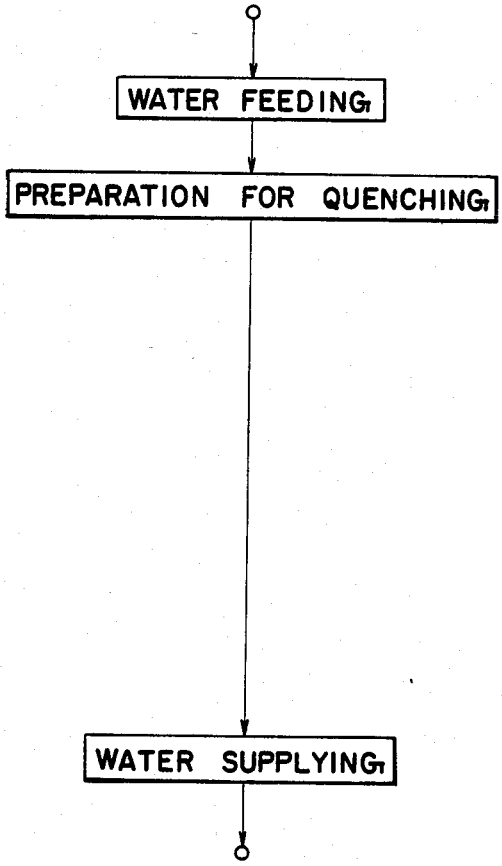

Incidentally, by using a plurality of transposed-pair-type cables $H_0$ to $H_n$, which are composed of portions opened at a predetermined width and portions densely transposed as shown in FIG. 5, the absolute address location of the $2^n$ can be realized by detecting the signals which are inductively coupled with the antenna at the opened portions but not at the dense portions and which correspond to the binary values "1" and "0".

Although the foregoing description has been limited to the address locations on the ground, the address of the quenching car locomotive can also be located by a similar method on the quenching car locomotive itself.

The main controller 10 serves to transmit and receive through the auxiliary cokery machinery controller 13 the instructions and data for the level of a water reservoir, the opening and closing operations of a quenching water value, and the starting and stopping operations of a quenching water supply pump with a quenching tower (not shown), the instructions and data for full and/or empty conditions of the coke wharf, the start and stop of a coke feeder, and troubles with the coke wharf, in addition to the instructions and data necessary for ascension pipes, a coal bunker and a deduster to store all of them.

Moreover, the main controller 10 thus far described is stored with the control programs of the respective working steps of the traveling machines 1 to 4 as shown in FIG. 6 and with the central addresses of the respective oven chambers, and is constructed, on the basis of the data fed through the auxiliary cokery machinery controller 13, the working oven chamber data fed from the operation and supervision console desk 11, and data from the respective traveling machines 1 to 4, to transmit the starting, stopping and working instructions of the respective traveling machines 1 to 4 to the radio sets 14 of the respective traveling machines 1 to 4 through the transmission controller 9, the transmission-receivers 8 and the IR cables thereby to control the respective traveling machines 1 to 4 and to receive and store the data of the working conditions thereby to send out the necessary data through the printer or typewriter 12.

Now, if the main controller 10 is fed with a predetermined oven chamber number designation in accordance with the working schedule from the console desk 11, it transmits the running instructions toward a first oven chamber for discharge to the pusher machine 1, the guide car 3 and the quenching car locomotive 4 in accordance with the control programs of the working steps of the pusher machine 1, coke guide 3 and quenching car locomotive 4 stored therein, thereby to start their respective driving motors. When the pusher machine 1, the coke guide 3 and the quenching car locomotive 4 start their runs, the respective address locators 7 continuously locate the respective absolute addresses of the pusher machine 1, the coke guide 3 and the quenching car locomotive 4 and feed them to the main controller 10. This main controller 10 is further fed with the respective velocity signals of the pusher machine 1, the coke guide 3 and the quenching car locomotive 4 from the respective radio sets 14 thereon through the respective transmitter-receivers 8 so that they compare and arithmetically operate, without any interruption, the central address of the predetermined oven chamber, the speed data of the pusher machine 1, the coke guide 3 and the quenching car locomotive 4, and the respective braking programs of the present positions, all of which are stored therein, thereby to determine brake instructing positions. When these brake instructing positions are reached, the main controller 10 transmits the respective braking instructions on the basis of the respective braking programs stored in advance to actuate the respective brakes of the pusher machine 1, the coke guide 3 and the quenching car locomotive 4 so that they may be stopped at the center address of the first oven chamber.

When the main controller 10 confirms, from the comparisons with the absolute addresses fed from the respective address detector 7, that the pusher machine 1, the coke guide 3 and the quenching car locomotive 4 have been stopped at the The center address of the predetermined oven chamber, it transmits a coke oven door removing instruction to the pusher machine 1 and the coke guide 3 on the basis of the control program of the working steps to actuate the door lifting machine of the pusher machine 1 and the guide car 3 thereby to remove the coke oven door.

When these coke oven door removing operations have been completed, an end signal is transmitted through the radio sets 14 of the pusher machine 1 and the coke guide 3. Then, the main controller 10 transmits a coke guide mounting instruction and a connecting duct advancing instruction for dedust to the coke guide 3 so that a guide mounting cylinder and a connecting duct actuating cylinder are operated to mount the guide and to advance the connecting duct until the latter is connected to a main duct.

Moreover, the main controller 10 transmits a coke oven door cleaning instruction to the pusher machine 1 and coke guide 3 so that a door cleaning machine may be actuated to clean the coke oven door. When the guide mounting and the connecting duct advancing are terminated, end signal is fed from the radio set 14 of the coke guide 3 to the main controller 10.

Simultaneously with the aforementioned connecting duct advancing instruction, the main controller 10 transmits a ground exhauster starting instruction for a guiding operation to the auxiliary cokery machinery controller 13 so that the ground exhauster may be started.

When the main controller 10 confirms that the operations thus far described have been completed, it transmits both a pusher ram advancing instruction to the pusher machine 1 so that the pusher ram may be advanced and a starting instruction to the quenching car locomotive 4 so that the quenching car locomotive 4 may be run in synchronism with the advancing speed of the pusher ram.

The main controller 10 receives from the pusher machine 1 an end signal of pushing, and then transmits a stopping instruction to the quenching car locomotive 4 so as to stop it and simultaneously transmits a pusher arm retracting instruction to the pusher machine 1 so as to retract it.

After that, when the main controller 10 transmits a running instruction to the quenching car locomotive 4 so that the quenching car locomotive 4 starts its run to the quenching tower, the central controller 10 compares and arithmetically operates the address of the quenching car locomotive 4, which is continuously fed from the address locator 7 of the address of the quenching car locomotive 4, the speed data, which are fed from the quenching car locomotive 4, and the address of the stop position in the quenching tower and the braking program, which are stored therein, thereby to determine a braking instruction address. When this braking instruction position is reached, the main controller 10 transmits the braking instruction on the basis of the braking program so that the quenching car locomotive 4 is accurately stopped at the stop position in the quenching tower in accordance with a predetermined deceleration value.

The main controller 10 transmits to the auxiliary cokery machinery controller 13 a quenching water supplying instruction to the quenching tower after it has confirmed that the quenching car locomotive 4 has been stopped at a predetermined address.

When fed with a drainage ending signal after the coke quenching operation, the main controller 10 transmits such a running instruction to the quenching car locomotive 4 as to run to the coke wharf. When the quenching car locomotive 4 starts its run to the coke wharf, the main controller 10 selects an appointed coke wharf on the basis of the data fed from the coke wharf and arithmetically determines a braking instructing address on the basis of the address of the quenching car locomotive 4, which is fed from the address detector 7, the speed data which is fed from the quenching car locomotive 4, and the central address of the coke wharf selected as well as on the basis of the braking program. When the quenching car locomotive 4 reaches the instructed braking address, the main controller 10 transmits a braking instruction on the basis of the braking program so that the quenching car locomotive 4 is stopped at the central address of the coke wharf selected in accordance with the predetermined deceleration value.

After having confirmed that the quenching car locomotive 4 was stopped, the main controller 10 transmits a coke dumping instruction to the quenching car locomotive 4 so that the coke unloading door of the quenching car is opened and closed to dump the coke to the coke wharf.

When fed with the pusher ram ending signal from the pusher machine 1, on the other hand, the main controller 10 transmits both a guide retracting instruction and a connecting duct retracting instruction to the coke guide 3 and a ground exhauster instruction for the guide operation to the auxiliary cokery machinery controller 13 thereby partly to retract the coke guide and the connecting duct and partly to stop the ground exhauster.

When fed with coke guide and connecting duct retraction completing signals, the main controller 10 transmits a frame sheet cleaning instruction to the pusher machine 1 and coke guide 3, after it has confirmed that an oven door cleaning completing signal from the pusher machine 1 and the coke guide 3, so that the sheet cleaning machine is advanced to clean the frame sheet.

When fed with the frame sheet cleaning completing signal from the pusher machine 1 and the coke guide 3, the main controller 10 transmits a coke oven door closing instruction to the pusher machine 1 and the coke guide 3 so that a door lifting machine is advanced to attach the coke oven door.

When fed with a coke oven door attachment completing signal from the pusher machine 1 and the coke guide 3, the main controller 10 transmits such a running signal to the pusher machine 1, and the coke guide 3 as to run to a second oven chamber to be discharged and sequentially instructs the works similar to the aforementioned ones.

On the other hand, the charging car 2 starts its running operation in response to the running instruction to a coal bunker at the time when the main controller 10 transmits such a running instruction to the pusher machine 1, the coke guide 3 and the quenching car locomotive 4 as to run the first oven to be discharged. The main controller 10 determines a braking instruction address by comparing and arithmetically operating the central address of a coal receiving position, which is selected on the basis of both the address data fed continuously from the address locator 7 of the charging car and the data fed from a coal bunker, the speed data fed from the charging car 2, and the braking program stored. When the charging car 2 reaches the brake instructing address, the main controller 10 transmits a braking instruction on the basis of the braking program so that the charging car 2 is stopped accurately at the central address of the coal receiving position selected in accordance with a predetermined deceleration value.

After it has been confirmed that the charging car 2 was stopped at the coal receiving address, the main controller 10 transmits a coal receiving instruction to the charging car 2 so that a coal tower cutting gate is opened and closed to load a predetermined quantity of coal.

When fed with a coal reception completing signal from the charging car 2, the main controller 10 transmits a running instruction to an oven to be charged, i.e., the first oven to be discharged so that the charging car 2 is run.

When the charging car 2 starts its run, the main controller 10 determines a brake instructing address by executing the comparisons and arithmetic operations on the basis of the address data fed from the address detector 7 of the charging car 2, the speed data fed from the charging car 2, and the central address of the oven chamber to be charged and the braking program both stored therein. When the charging car 2 reaches the brake instruction address, the main controller 10 transmits on the basis of the braking program so that the charging car 2 is stopped accurately at the central position of the oven chamber to be charged in accordance with a predetermined deceleration value.

After having confirmed that the charging car 2 has stopped at the central address of the oven of the number to be charged, that it is fed with a coke oven door attachment completing signal from the pusher machine 1 and the coke guide 3, and that the pusher machine 1 has stopped at the address of the second oven chamber to be discharged, the main controller 10 transmits an ascension pipe edging instruction, a high-pressure gas liquor injecting instruction and a ground exhauster starting instruction for the charging operation to the auxiliary cokery machinery controller 13 thereby to close a top cover but open a dish-shaped valve, to open a high-pressure gas liquor valve and to start an earthly exhauster for the charging operation.

When fed with an ascension pipe edging completing signal, a high-pressure gas liquor valve opening completing signal and an earthly exhauster start completing signal for the charging operation, main controller 10 transmits a charging hole lid opening instruction, an oven top cleaning instruction, a deduster connecting duct advancing instruction and a preduster on the charging car 2 starting signal to the charging car 2 to actuate a lifting magnet thereby to open a charging hole lid, to start an oven top cleaner, to connect a dedusting connecting duct, and to start a preduster on the car.

When fed with a charging hole lid opening completing signal, a dedusting connecting duct connection completing signal and a preduster on the charging car start completing signal, the main controller 10 transmits a drop sleeve descending signal to the charging car 2 so that the drop sleeve is mounted in a charging hole. When the drop sleeve mount completing signal is received, the main controller 10 transmits a charge starting instruction to the charging car 2 so that a table feeder is driven to start the charging operation. At the time a predetermined amount of coal is charged, a levelling door opening instruction is transmitted from the main controller 10 to the pusher machine 1 so that the levelling door opening and closing device of the pusher machine 1 is actuated to open a levelling door and to mount a levelling chute in a levelling hole.

When fed with a levelling door opening completing signal from the pusher machine 1 and a levelling starting signal from the charging car 2, the main controller 10 transmits a levelling operation starting instruction to the pusher machine 1 so that a leveller is reciprocated to conduct its levelling operation.

When fed with a charge completing signal from the charging car 2, the main controller 10 transmits a leveller retracting instruction to the pusher machine 1 to retract both the leveller and the levelling chute. During this time, the main controller 10 has already been fed with the oven top cleaning completing signal.

When fed with a levelling operation completing signal from the pusher machine 1, the main controller 10 transmits both a levelling door closing instruction to the pusher machine 1 to close the levelling door and a drop sleeve lifting instruction to the charging car 2.

When fed with a drop sleeve lift completing signal, the main controller 10 transmits a charging hole lid mounting instruction to the charging car 2 so that the lifting magnet is actuated to mount the charging hole lid.

When fed with a lifting magnet mount completing signal, the main controller 10 transmits a preduster on the charging car stopping instruction and a connecting duct retracting instruction to the charging car 2 to stop exhauster of preduster and to retract, and transmits a ground exhauster collecting blower stopping instruction for the charging car and a high-pressure gas liquor valve closing instruction to the auxiliary cokery machinery controller 13 to stop a ground exhauster for the charging operation and to close a high-pressure gas liquor valve.

When fed with a preduster on the charging car stop completing signal, a connecting duct retraction completing signal, an earthly exhauster stopping signal and a high-pressure gas liquor valve closing signal, the main controller 10 transmits the charging car 2 to run to its coal receiving address.

Meanwhile, the pusher machine 1, the coke guide 3 and the quenching car locomotive 4 are being instructed to discharge works of the second oven chamber.

The respective traveling machines are automatically controlled by repeating the steps thus far described.

As has been described hereinbefore, according to the present invention, since the transposed-pair-type inductive radio cables are arranged over the whole length of running path of the respective traveling machines, and since the absolute addresses of the respective traveling machines are continuously located at the central control system by the continuous address detecting mechanism resorting to the absolute address detecting method, the addresses can be located accurately stepwise of 10 mm, for example, with neither requirement for any mechanical contact mechanism such as the idler wheel rotating system nor any error due to slippage or the like. Moreover, although the present invention is directed to the contactless address detection, it can sufficiently cope with the changes in the relative positions between IR cables and traveling antenna as large as 300 mm in the vertical and horizontal directions.

For the braking decelerations and the stops of the respective traveling machines, proper braking operations can be ensured in accordance with the deceleration values stored in advance in the computer by comparing without any interruption the signal of the speed detector carried on the traveling machines and the present addresses detected by the inductive radio address detection so that the traveling machines can be stopped remarkably accurately at fixed positions.

Although the foregoing description is directed to the automatic control of the working operations of all the respective traveling machines, the present invention is also effective for the automatic control of the quenching car only, i.e., the remote control of the run of the quenching car, which is made coactive with the pusher machine to conduct the loading operation of red hot coke. In this case, it is sufficient to arrange transposed-pair-type inductive radio cables (IR cables) also capable of data transmissions over the whole length of the running path of the quenching car; to continuously locate the absolute address of the quenching car locomotive at on-board control for quenching car controller in place of the foregoing main control system by means of a continuous address detecting mechanism resorting to the absolute address detection and to instruct the running and stopping operations of the quenching car locomotive and the loading and dumping operations of coke consecutively in accordance with the working steps on the basis of the working step control program, the central addresses of the respective oven chamber, the quenching tower stopping position addresses, and the central addresses of the respective coke wharfs, all of which are stored in afore-mentioned controller, and on the basis of the speed data and the working step data of the pusher machine. The specific explanations of the operations mentioned above are absolutely similar to those of the case of the whole working steps, and they are accordingly omitted.

Incidentally, when the central addresses of the respective oven chambers are to be stored in the main controller or on the on-board controller for the quenching car control, the displacement in the relative positions of the respective central oven address of the oven chamber due to the expansion and contraction of the coke oven is corrected by adding a function to correct the central addresses of the oven chamber in accordance with the season and weather conditions so that the detecting accuracy can be maintained.

Even if the power supply is interrupted, moreover, it is possible to detect the present address thereby to continue the works in accordance with advantages offered by the present invention at the instant when the power supply is restored.

Next, one embodiment of an apparatus for controlling the stops of the traveling machines at fixed position will be described with reference to the accompanying drawings.

Here, the following description is directed to the situation in which the present invention is applied to such a coke oven plant as is equipped with an absolute address detector having IR cables of a detection unit of 10 mm.

The above-specified locator is made operative partly to detect the positions as addresses of $2^n$ over the whole length of the running path of the quenching car by designating the signals, which are received by the untransposed phase reference pairs and the respective pairs transposed at different pitches in the transposed-pair-type cables, such that their portions in phase with the phase reference pairs are designated at "0" whereas their portions in opposite phase to the same are designated at "1" and partly to locate the addresses at a unit not exceeding 5 mm by detecting the phases of the signals which are received by the minimum transposed pairs lines.

Figure 7:
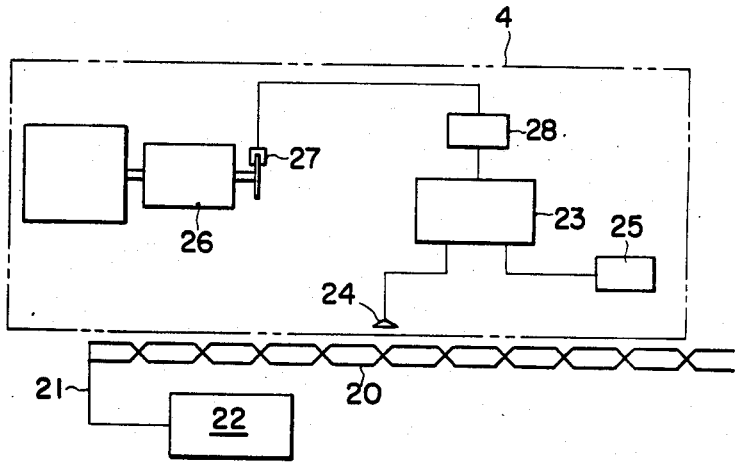
FIG. 7 is a block diagram showing one example of a fixed position stop controller.

As shown in FIG. 7, more specifically, IR cables 20 are arranged along the tracks of the quenching car locomotive 4 and are connected through an approach cable 21 with an oscillator 22 installed on the ground. On the quenching car locomotive 4, on the other hand, there are carried an on-board controller 23 having a built-in address detector, a traveling antenna 24, and a speed detector 25. To an A.C. electric motor 26 for driving the quenching car locomotive 4, moreover, there is attached a hydraulic disc brake 27 to which a hydraulic controller 28 connected to the on-board controller 23 is connected.

Figure 8:
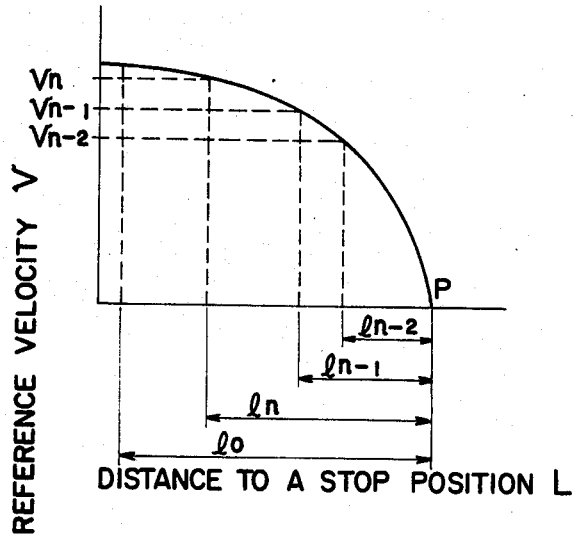
FIG. 8 is a chart illustrating a reference deceleration curve which is obtained from a reference velocity v and a distance to a stop position L.

As shown in FIG. 8, on the other hand, the on-board controller 23 is fed and stored with a reference distance-velocity pattern relative to a stopping target position P.

Figure 9:
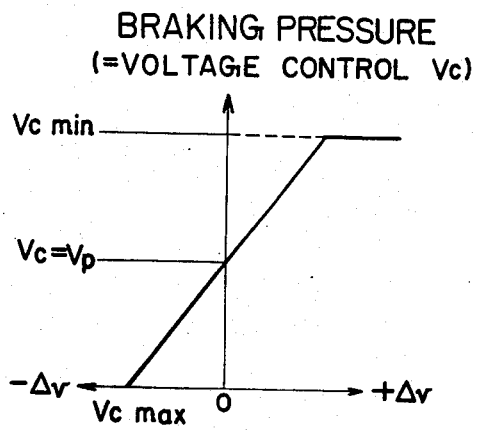
FIG. 9 is a diagram illustrating a change in the brake pressure control voltage ($\bar{v}$) and velocity difference ($\Delta v$) between the actual velocities (v) and reference velocities (v')

Thus, the signals transmitted from the oscillator 22 are received through the IR cables 20 by a traveling antenna 24. When the distances of the addresses of the quenching car locomotive 4 located by the on-board controller 23 relative to the target position P are changed as indicated at $l_n$, $l_{n-1}$, $l_{n-2}$, and so on, the on-board controller 23 transmits the control voltage signal $V_c$, which are computed by the following equation, as shown in FIG. 9, in accordance with the difference $\Delta v$ between the actual velocities, $v_n'$, $v_{n-1}'$, $v_{n-2}'$ and so on at the respective instants, which are fed from the speed oscillator 25 to the on-board controller 23, and the reference velocities $v_n$, $v_{n-1}$, $v_{n-2}$, and so on so that the oil pressure of the hydraulic disc brake 27 may be controlled to regulate the braking pressure thereby to stop the quenching car locomotive 4 accurately at the stopping target position P:

$$V_c = V_p - K_1\Delta v - K_2\int \Delta v dt,$$

wherein:

$V_p$: the reference voltage at the reference deceleration;

$K_1$ and $K_2$: control constants; and $V_c$: brake pressure control voltage.

In this case, the hydraulic disc brake 27 has little self-boosting action, because it is constructed such that it applies a pad to the surface of the rotating disc, so that the brake torque obtained is proportional to the brake controlling oil pressure. Since equal braking is ensured for either forward or rearward movements because of a lack of a self-boosting force, moreover, the quenching car locomotive 4 can be stopped highly accurately and correctly at the stopping target point P.

Figure 10:
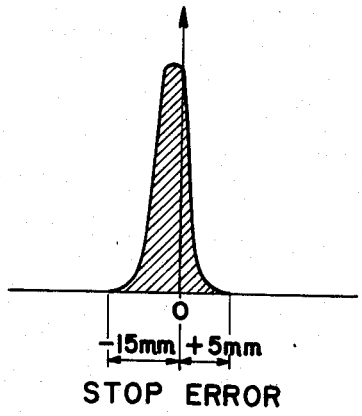
FIG. 10 is a diagram illustrating the braked result in terms of a stop error.

The result in the present invention is applied to the quenching car locomotive 4 which is equipped with the absolute address detecting method having the aforementioned IR cables and which is controlled in a notched manner by the drive of the A.C. electric motor, is illustrated in FIG. 10. From this Figure, it is understood that the present invention has succeeded in stopping the quenching car locomotive 4 correctly with an accuracy within a range of +5 mm to −15 mm with respect to the stopping target position.

As has been described hereinbefore, according to the present invention, the hydraulic disc brakes are incorporated as the drive mechanisms of the traveling machines, and the continuously detected actual velocites are compared with the reference velocity curve, which has been determined from the predetermined velocity and from the distance to the stop position, so that the braking pressure is adjusted for the deceleration continuously on the basis of the compared difference.

As a result, it is possible to stop the traveling machines at the predetermined addresses within a shorter period than the prior art, in which the deceleration is stepwise effected, while delaying none of the oven unlooading time period. Thus, the present invention can have a remarkable contribution to the operations of the coke oven plant.

What is claimed is:

1. An automatic control method for cokery machinery which includes traveling machines that move along associated running paths and a main controller, said traveling machines including a pusher machine, a charging car, a coke guide, and a quenching car, each of said traveling machines having a speed and absolute address along its associated running path and a working condition, said central controller containing a control program for the absolute address and working condition of each traveling machine, said method comprising the steps of:

(a) arranging a transposed-pair-type inductive radio line capable of data transmission over the whole length of each of the running paths of the traveling machines, each said radio line being composed of phase reference pairs R having no transposition and transposed paired lines $G_0$ to $G_n$ transposed with different pitches;

(b) designating in binary notation the phases of the signals which are to be received by the respective paired-lines of said transposed-pair-type inductive radio lines such that the portions in phase with the phase reference pairs R are expressed by "0" whereas the portions in opposite phase to the pairs R are expressed by "1", thereby locating the absolute addresses by $2^n$ over the whole length of the running paths of the respective traveling machines and detecting the absolute addresses of said respective traveling machines at the central controller by means of a continuously position-detecting mechanism which uses an absolute address-detecting method in which the signals received by the paired lines $G_0$ are phase-shifted to continuously detect the distance from at least one of the points of intersection of transposed pair lines $G_0$; and (c) controlling the running, stopping and working operations of said respective traveling machines based on the control programs in said main controller and the speed, absolute address, and working condition of said respective traveling machines.

2. An automatic run control method for automatically controlling the operation of a quenching car of a coke oven plant, said coke oven plant including an oven, a quenching tower and a plurality of coke wharfs, said oven including a pusher machine which has a speed and working condition of operation, said quenching car being movable along a running path which extends from an oven centering address, a quenching tower stop position address, and coke wharf central positions, said quenching car including an on-board controller and being characterized by a speed and absolute address along said running path, as well as a working condition such as a running, stopping, loading and unloading condition, said method comprising the steps of:

(a) arranging a transposed-pair-type inductive radio line capable of data transmission over the whole length of the running path of said quenching car, said radio line being composed of phase reference pairs R having no transposition and transposed paired lines $G_0$ to $G_n$ transposed with different pitches;

(b) designating in binary notation the phases of the signals which are to be received by the respective paired-lines of said transposed-pair-type inductive radio lines such that the portions in phase with the phase reference pairs R are expressed by "0" whereas the portions in opposite phase to the pairs R are expressed by "1", thereby locating the absolute addresses by $2^n$ over the whole length of the running path of said quenching car and detecting the absolute address of said quenching car at the on-board controller by means of a continuously position-detecting mechanism which uses an absolute address-detecting method in which the signals received by the paired lines $G_0$ are phase-shifted to continuously detect the distance from at least one of the points of intersection of transposed pair lines $G_0$; and (c) controlling the running, stopping, loading and unloading condition of said quenching car in accordance with the oven centering address, the quenching tower stop position address, and each coke wharf central position, which are stored in said on-board controller, and the speed and working condition of said pusher machine.

* * * * *